United States Patent [19]

Roach et al.

[11] 4,119,456

[45] Oct. 10, 1978

[54] HIGH-STRENGTH CAST HEAT-RESISTANT ALLOY

[75] Inventors: Donald Brian Roach; John Andrew Van Echo; Albert Mangold Hall, all of Columbus, Ohio

[73] Assignee: Steel Founders' Society of America, Rocky River, Ohio

[21] Appl. No.: 763,905

[22] Filed: Jan. 31, 1977

[51] Int. Cl.[2] ..... C22C 30/00; C22C 19/05; C22C 38/44; C22C 38/50

[52] U.S. Cl. ..... 75/122; 75/128 W; 75/128 Z; 75/134 F; 75/171

[58] Field of Search ..... 75/122, 128 R, 128 W, 75/128 Z, 134 F, 171

[56] References Cited

U.S. PATENT DOCUMENTS

| | | | |
|---|---|---|---|
| 2,019,688 | 11/1935 | Lohr | 75/128 Z |
| 2,047,916 | 7/1936 | Lohr | 75/128 Z |
| 2,157,060 | 5/1939 | Schafmeister | 75/128 Z |
| 3,260,594 | 7/1966 | Ornitz et al. | 75/128 R |
| 3,366,473 | 1/1968 | Nehrenberg et al. | 75/122 |
| 3,758,294 | 9/1973 | Bellot et al. | 75/134 F |
| 3,865,581 | 2/1975 | Sekino | 75/128 Z |
| 3,917,493 | 11/1975 | Mimino et al. | 75/128 Z |
| 3,993,475 | 11/1976 | Harada et al. | 75/134 F |
| 4,026,699 | 5/1977 | Eiselstein et al. | 75/134 F |

FOREIGN PATENT DOCUMENTS

| | | | |
|---|---|---|---|
| 662,432 | 6/1938 | Fed. Rep. of Germany | 75/128 Z |

*Primary Examiner*—Arthur J. Steiner
*Attorney, Agent, or Firm*—Fay & Sharpe

[57] ABSTRACT

A high-strength, heat-resistant alloy is provided which comprises, in weight percent, about 0.2 to about 0.75 percent carbon, from about 20.0 to about 30.0 percent chromium, from about 15.0 to about 60.0 percent nickel, up to about 2.0 percent manganese, up to about 2.5 percent silicon, from about 3.0 to about 10.0 tungsten, from about 0.1 to about 1.0 zirconium, with the balance being iron plus incidental impurities.

5 Claims, 1 Drawing Figure

FIG.
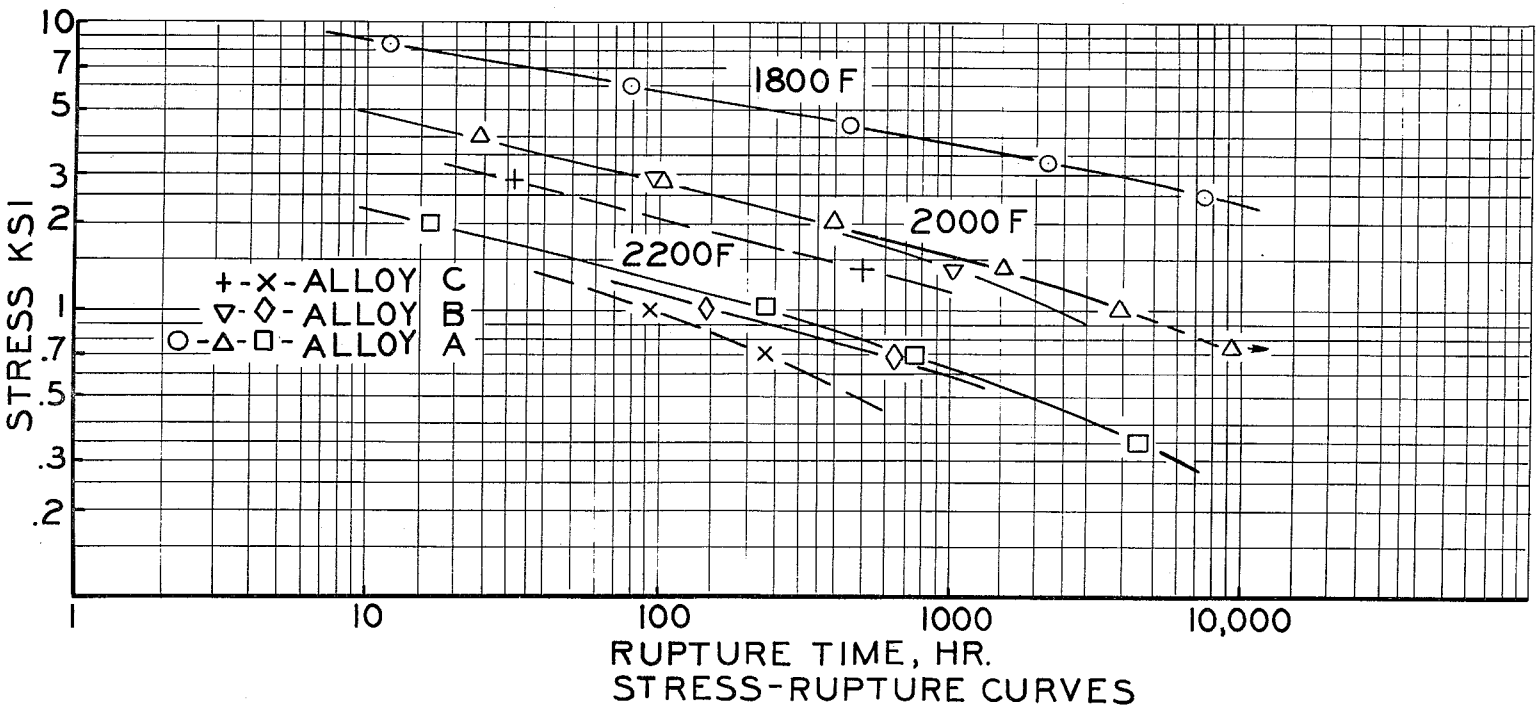

HIGH-STRENGTH CAST HEAT-RESISTANT ALLOY

BACKGROUND OF THE INVENTION

The present invention concerns a carbon containing heat-resistant iron-chromium-nickel base alloy composition which, in the cast state, exhibits excellent creep and rupture strengths at temperatures in the range of about 1800° to 2200° F, excellent creep ductility and oxidation resistance, is weldable, and can be economically manufactured under normal commercial foundry conditions.

The alloy composition of the instant invention is readily melted and can be cast either statically or centrifugally. In addition, the concerned alloy does not require heat treatment in order to obtain its exceptionally good creep and rupture properties. The alloy composition of the invention exhibits exceptional creep ductility for a high-strength cast heat-resistant alloy, with creep ductility at rupture always exceeding 15 percent in 2 inches in long-time creep rupture tests at 1800° to 2200° F.

Heat-resistant iron-chromium-nickel containing alloys are well known in the art and today find a myriad of uses in industry. For example, such alloys are used in high-temperature furnaces and in various types of processing equipment, such as conveyor rolls for steel processing, furnace tube hangers and supports, and reaction tubes in chemical processing. In use, these components are exposed to the combustion products of fossil fuels and, in the case of tubular products for chemical processing, to various reducing and oxidizing feed stocks. These alloys, consequently, must resist oxidation, sulfidation, and carburization. Of particular importance, however, are the creep and rupture properties of these alloys at temperatures in the range of 1800° to 2200° F.

While conventional alloys are generally suitable for use in connection with the foregoing purposes, they all generally suffer from a lack of good creep and rupture properties at temperatures in excess of about 1800° F.

Accordingly, it is the primary objective of the present invention to provide an alloy composition which overcomes the problems associated with prior art alloys.

Other objects of the invention will be apparent to those skilled in the art from a reading of the present specification and claims.

SUMMARY OF THE INVENTION

The present invention concerns an improved high-strength, heat-resistant iron-chromium-nickel alloy having improved mechanical properties which are obtained by adding thereto an effective amount of zirconium which forms a dispersed carbide particle by reacting with the carbon present in the alloy.

In one aspect, the subject invention relates to a high-strength, heat-resistant alloy comprising, in weight percent, about 0.2 to about 0.75 percent carbon, from about 20.0 to about 30.0 percent chromium, from about 15.0 to about 60.0 percent nickel, up to about 2.0 percent manganese, up to about 2.5 percent silicon, from about 0.1 to about 1.0 zirconium, with the balance being iron plus incidental impurities.

In another aspect, the subject invention concerns a high-strength, heat-resistant alloy comprising, in weight percent, about 0.2 to about 0.75 percent carbon, from about 20.0 to about 30.0 percent chromium, from about 15.0 to about 60.0 percent nickel, up to about 2.0 percent manganese, up to about 2.5 percent silicon, from about 3.0 to about 10.0 tungsten, from about 0.1 to about 1.0 zirconium, with the balance being iron plus incidental impurities.

DESCRIPTION OF THE PREFERRED EMBODIMENTS OF THE INVENTION

It has been found that certain carbon containing iron-chromium-nickel alloys can be strengthened by the in situ formation of dispersed carbide particles. These particles act as dispersion strengtheners, impeding slip and creep and improving rupture strength significantly. The carbide forming metals in this alloy include tungsten and zirconium. Either metal can be used alone for this purpose but superior results are obtained when both metals are utilized concurrently.

The resultant superior properties of alloy compositions of the invention appear to result from a proper selection of critical amounts of the various alloy constituents. That is, when tungsten and/or zirconium in certain critical amounts are added to an iron-chromium-nickel alloy of the type disclosed a novel alloy is obtained which exhibits high temperature creep and rupture properties which are superior to those exhibited by the base alloy without the addition of tungsten and/or zirconium.

Broadly, the compositional range of the preferred alloy of the invention is as follows:

| | |
|---|---|
| Carbon | About 0.2 to about 0.75 percent |
| Chromium | About 20.0 to about 30.0 percent |
| Nickel | About 15.0 to about 60.0 percent |
| Tungsten | About 3.0 to about 10.0 percent |
| Zirconium | About 0.1 to about 1.0 percent |
| Iron (plus minor amounts of other elements) | Balance |

The foregoing compositional ranges were selected for the following reasons:

(1) At carbon levels below 0.2%, reduced high-temperature strength is anticipated, but above 0.75% carbon, ductility and weldability problems are anticipated.

(2) A chromium content of 20% is required for good oxidation and high-temperature corrosion resistance. Experience has shown that no significant further improvement in oxidation resistance is attained at chromium contents above 30%.

(3) A nickel content of about 15% is required to ensure good stability in the microstructure and to prevent the formation of embrittling phases, such as sigma. Nickel contents above 60% are not required, and increase the alloy costs and content of critical material.

(4) At tungsten contents of less than 3% , inferior creep rupture properties result. Tungsten contents above 10% increase oxidation rates and contribute little additional strengthening.

(5) Zirconium appears to be a beneficial addition agent when present in an amount of above about 0.1 percent. A maximum zirconium content of 1% was selected because difficulty in casting clean heats containing over 1% zirconium was anticipated.

Other elements may be included in the basic alloy composition. These elements are added as desired. Typical of such elements are manganese and silicon. In the art it is well known to add manganese and silicon to iron-chromium-nickel alloys for deoxidation purposes. Also, silicon additions of up to 2.5% are known to improve resistance to oxidation and other forms of high temperature corrosion.

In practice, it has been found that the preferred alloy contains the following ingredients within the recited ranges.

| | |
|---|---|
| Carbon | About 0.4 to about 0.6 percent |
| Chromium | About 24.0 to about 28.0 percent |
| Nickel | About 33.0 to about 37.0 percent |
| Tungsten | About 3.0 to about 7.0 percent |
| Zirconium | About 0.1 to about 1.0 percent |
| Iron (plus minor amounts of other elements) | Balance |

Three heats of the above preferred composition were melted and centrifugally cast in the form of 5 inch O.D. × 3½ inch I.D. tubes under conventional production conditions in three commercial foundries. Each of these heats was tested in creep rupture at temperatures in the range of 1800° to 2200° F. Standard 0.505 inch diameter specimens having a 2 inch gage length were tested to times exceeding 6000 hours. The composition of each of these three heats and their creep rupture properties are given in the Table. Also cited in this table for comparison purposes are specific results obtained on similar alloys which do not contain zirconium.

TABLE

CREEP RUPTURE RESULTS FOR Fe-Cr-Ni ALLOYS

| Temperature | Stress, ksi | Rupture Time, hours | Elongation percent in 2 Inches | Minimum Creep Rate, percent/hour |
|---|---|---|---|---|
| | | Alloy A | | |
| 1800 F | 6.0 | 79.0 | 31.1 | 0.15 |
| | 4.5 | 451.5 | 26.0 | 0.018 |
| | 3.2 | 2183.8 | 22.1 | 0.0021 |
| | 2.5 | 7418.2 | 18.3 | 0.0005 |
| 2000 F | 2.8 | 102.4 | 34.5 | 0.057 |
| | 2.0 | 393.5 | 26.8 | 0.011 |
| | 1.4 | 1510.3 | 28.5 | 0.0022 |
| | 1.0 | 2842.1 | 19.2 | 0.00035 |
| | 0.75 | 9153(a) | 7.27 | 0.00020 |
| 2200 F | 2.0 | 16.6 | 36.6 | 0.48 |
| | 1.0 | 236.5 | 45.1 | 0.018 |
| | 0.70 | 738.8 | 42.6 | 0.0071 |
| | 0.35 | 4427.1 | 35.3 | 0.0012 |
| | | Alloy B | | |
| 2000 F | 2.8 | 94.2 | 31.7 | 0.05 |
| | 1.4 | 1031.0 | 21.7 | 0.003 |
| | 1.0 | 2883.5 | 27.4 | 0.0012 |
| 2200 F | 1.0 | 149.1 | 50.8 | 0.045 |
| | 0.7 | 696.8 | 27.4 | 0.014 |
| | 0.35 | 2516.4 | 36.5 | 0.0022 |
| | | Alloy C | | |
| 2000 F | 2.8 | 31.5 | 16.2 | 0.10 |
| | 1.4 | 499.4 | 26.4 | 0.0064 |
| 2200 F | 1.0 | 94.2 | 31.1 | 0.09 |
| | 0.7 | 232.5 | 24.6 | 0.032 |

(a) still in test as of Dec. 1, 1976

Compositions of Alloys

| | Chemical Composition, % | | | | | | | |
|---|---|---|---|---|---|---|---|---|
| Alloy | C | Cr | Ni | Si | Mn | W | Zr | Fe |
| A | 0.52 | 26.0 | 34.8 | 0.76 | 0.63 | 5.3 | 0.34 | balance |
| B | 0.46 | 26.8 | 36.0 | 0.76 | 0.56 | 5.6 | 0.27 | balance |
| C | 0.53 | 26.5 | 35.0 | 1.9 | 0.68 | 4.2 | 0.01 | balance |

The rupture stress versus time plots for the stress zirconium-containing heats are depicted graphically in the FIGURE.

It will be noted in both the Table and FIGURE that alloys A and B containing about 0.52 and 0.46% carbon, 5.3 and 5.5% tungsten, 0.34 and 0.27 zirconium, respectively, have similar creep and rupture properties. On the other hand, alloy C containing 0.52% carbon, 4.2% tungsten, and 0.01% zirconium has significantly lower creep and rupture strengths. It will also be noted that the zirconium-containing alloys (A, B and C) have significantly higher creep ductility values than the nonzirconium-containing alloys as indicated in the Table. The good rupture life and excellent creep ductility of alloy A tested at the very high temperature of 2200° F and a stress of 350 psi is indeed exceptional and above the current state of the art. The relatively low slopes of the stress versus rupture time plots for alloys A and B (see FIGURE) at 2000° and 2200° F. substantiate the contention of good high-temperature stability in these alloys.

The above combination of creep and rupture strengths and ductility at 2000° and 2200° F. are considered new and novel in a high-carbon cast heat-resistant alloy. Moreover, these properties are obtained in as-cast material. Heat treatment is not required to obtain such results.

While there have been described what are at present considered to be the preferred embodiments of this invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. A high-strength, heat-resistant castable alloy consisting of about 0.2 to about 0.75 percent carbon, about 20.0 to about 30.0 percent chromium, from about 15.0 to about 60.0 percent nickel, up to about 2.0 percent manganese, up to about 2.5 percent silicon, from about 3.0 to about 10.0 tungsten, from about 0.1 to about 1.0 zirconium, with the balance being iron plus incidental impurities.

2. The high-strength, heat-resistant alloy of claim 1 wherein carbon is present in an amount ranging from about 0.4 to about 0.60 percent.

3. The high-strength, heat resistant alloy of claim 1 wherein chromium is present in an amount ranging from about 24.0 to about 28.0 percent.

4. The high-strength, heat-resistant alloy of claim 1 wherein nickel is present in an amount ranging from about 33.0 to about 37.0 percent.

5. The high-strength, heat-resistant alloy of claim 1 wherein tungsten is present in an amount ranging from about 3.0 to about 7.0 percent.

* * * * *